US009095247B2

(12) United States Patent
Rekola

(10) Patent No.: US 9,095,247 B2
(45) Date of Patent: Aug. 4, 2015

(54) FLOOR MAINTENANCE DEVICE AND CLOTH

(76) Inventor: Petri Rekola, Helsinki (FI)

( * ) Notice: Subject to any disclaimer, the term of this patent is extended or adjusted under 35 U.S.C. 154(b) by 168 days.

(21) Appl. No.: 13/642,829

(22) PCT Filed: Apr. 23, 2010

(86) PCT No.: PCT/FI2010/000028

§ 371 (c)(1),
(2), (4) Date: Dec. 24, 2012

(87) PCT Pub. No.: WO2011/131820

PCT Pub. Date: Oct. 27, 2011

(65) Prior Publication Data

US 2013/0205526 A1 Aug. 15, 2013

(51) Int. Cl.

| | |
|---|---|
| ***A47L 13/11*** | (2006.01) |
| ***A47L 13/12*** | (2006.01) |
| ***A47L 13/256*** | (2006.01) |
| ***A47L 13/44*** | (2006.01) |
| ***A47L 13/16*** | (2006.01) |

(52) U.S. Cl.

CPC ..... *A47L 13/12* (2013.01); *A47L 13/11* (2013.01); *A47L 13/16* (2013.01); *A47L 13/256* (2013.01); *A47L 13/44* (2013.01)

(58) Field of Classification Search

CPC ..... A47L 13/12; A47L 13/11; A47L 13/16; A47L 13/24; A47L 13/46

USPC ..... 15/118, 114, 209.1

See application file for complete search history.

(56) References Cited

U.S. PATENT DOCUMENTS

| | | | | |
|---|---|---|---|---|
| 4,254,527 | A | 3/1981 | Pfeifer | 15/121 |
| 6,329,308 | B1 | 12/2001 | Kenmochi et al. | 442/394 |
| 2009/0249640 | A1 | 10/2009 | Sufleta | 34/397 |

FOREIGN PATENT DOCUMENTS

| | | | | |
|---|---|---|---|---|
| DE | 008511694 | U1 | * | 11/1994 |
| DE | 8511694 | U | | 1/1995 |
| DE | 102004014371 | A1 | | 10/2005 |
| DE | 102006020986 | A1 | * | 11/2007 |
| EP | 0 271 295 | A2 | | 6/1988 |
| FI | 108209 | B | | 12/1999 |
| FR | 1387384 | A | | 1/1965 |
| JP | 2002-000531 | A | | 1/2002 |
| JP | 2003-325413 | A | | 11/2003 |
| JP | 2003325413 | A | * | 11/2003 |

* cited by examiner

*Primary Examiner* — Shay Karls

(74) *Attorney, Agent, or Firm* — Kubovcik & Kubovcik

(57) ABSTRACT

A floor maintenance device (10) comprising a base portion (40), a squeegee portion (30) joined with the base portion (40), the squeegee portion being composed of rubber or other elastic material, and a fastening portion (50) of a cloth (60) to attach the cloth to the floor maintenance device (10). The cloth fastening portion is formed by a groove (51) to which the cloth can be attached by placing a thick edge (61) of the cloth in the groove. In the edge portion of the cloth, there is a compatible thick edge which can be placed in the groove forming the cloth coupling portion in the floor maintenance device.

3 Claims, 7 Drawing Sheets

PRIOR ART

FLOOR MAINTENANCE DEVICE AND CLOTH

OBJECT OF THE INVENTION

The object of the invention is a floor maintenance device comprised of

- a base portion,
- a squeegee portion composed of rubber or other elastic material and attached to the base portion,
- a cloth fastening portion to attach a cloth to the floor maintenance device, and
- a shaft attached to the base portion that is either rigid or swivels, by means of a joint.

PRIOR ART

Publication EP 0271295 A2 describes a floor maintenance device with a squeegee portion. A cloth is attached to the floor maintenance device so that the cloth is pressed onto the base of the squeegee portion by means of a grip. Such a floor maintenance device can be used for sweeping floors either with a dry or a moist cloth. Floors can also be washed using a wet cloth by pressing the cloth against the floor by means of the squeegee portion. The floor can subsequently be wiped dry using the squeegee portion and the cloth.

Such floor maintenance devices are quite practical and flexible and have become popular cleaning equipment. Fastening the cloth to the of the floor maintenance device has proved problematic, however. It should be possible to easily and quickly fasten and release the cloth, but at the same time the cloth should remain rigidly and reliably in place during use. In said publication EP 0271295 A2, the cloth is fastened to the floor maintenance device by pressing the cloth onto the base using two grips attached to the shaft. As the cloth is fastened to the base of the floor maintenance device at two places only, the cloth will clearly not stay in place very well.

PURPOSE OF THE INVENTION

The purpose of this invention is to create a floor maintenance device which overcomes the above-mentioned drawbacks. A further purpose of the invention is to create a floor maintenance device with a new, effective solution for fastening the cloth to the base of the floor maintenance device. Yet another purpose of the invention is to create a new type of cloth which can be reliably fastened to the floor maintenance device.

Characteristics of the Floor Maintenance Device According to the Invention

The floor maintenance device according to the invention is characterised in that the cloth fastening portion consists of a groove into which the cloth can be attached by inserting a thick edge of the cloth into the groove.

Embodiments of the Floor Maintenance Device According to the Invention

An advantageous embodiment of the floor maintenance device according to the invention is characterised in that a groove has been arranged in the base portion of the floor maintenance device.

Another advantageous embodiment of the floor maintenance device according to the invention is characterised in that the groove has an inner, wide portion for the thick edge of the cloth, and an outer, narrow portion or slit where the rest of the cloth comes out of the groove. Thus the groove forms a tunnel-like space with a narrow slit in its outer side. The narrow slit prevents the thick edge of the cloth from coming out of the tunnel-like space, whereby the cloth stays firmly in its place.

A third advantageous embodiment of the floor maintenance device according to the invention is characterised in that the thick edge of the cloth is placed in the groove by guiding it in at the end of the base portion. Similarly, the cloth is removed from the groove by pulling the thick edge of the cloth out of the groove end. The tunnel-like space formed by the groove can be open either at one end or at both ends.

A fourth advantageous embodiment of the floor maintenance device according to the invention is characterised in that, at the end of the groove, it has an expanding portion making it easier to guide the thick edge of the cloth into the groove at its end.

A fifth advantageous embodiment of the floor maintenance device according to the invention is characterised in that the groove comprises a fixed portion and a mobile portion which jointly form a tunnel-like space with an internal wide portion for the thick edge of the cloth and an outer narrow portion or slit where the rest of the cloth comes out of the groove.

A sixth advantageous embodiment of the floor maintenance device according to the invention is characterised in that the mobile portion of the groove can be manipulated to open the tunnel-like groove so that the slit in the side of the groove becomes larger whereby the thick edge of the cloth can be removed from the groove via the slit. Advantageously, it is not necessary to remove a used and soiled cloth by pulling it out through the end of the groove. It is very convenient to be able to remove a soiled cloth from the floor maintenance device without having to touch it.

Cloth According to the Invention

An additional purpose of the invention is to create a new type of cloth which can be reliably attached to the floor maintenance device.

Characteristics of the Cloth According to the Invention

The cloth according to the invention is characterised in that one edge of the cloth has a thick edge which can be placed in the groove forming the cloth coupling portion in the floor maintenance device.

Embodiments of the Cloth According to the Invention

An advantageous embodiment of the cloth according to the invention is characterised in that the thick edge of the cloth is formed by at least a double-folded edge of the cloth.

Another advantageous embodiment of the cloth according to the invention is characterised in that, in the thick edge portion of the cloth, an additional thread, cord, band or similar is placed between the folded cloth layers.

A third advantageous embodiment of the cloth according to the invention is characterised in that at least a portion of the cloth is so thin in the vicinity of the thick edge portion that it is compatible with the slit in the side of the groove in the floor maintenance device.

A fourth advantageous embodiment of the cloth according to the invention is characterised in that the cloth comprises, in addition to a thick edge and thin portion in the vicinity of the slit, a thicker portion for wiping and/or drying

EXAMPLES OF EMBODIMENTS

In the following, the invention is described using examples with reference to the appended drawings, in which

LIST OF FIGURES

FIG. 1 is a side view of a floor maintenance device according to the prior art, which is a squeegee without a cloth fastening portion.

FIG. 2 is a schematic view of a floor maintenance device according to the invention where the cloth is fastened to the floor maintenance device by a fastening portion according to the invention.

FIG. 3 is a partly cross-sectional view of a portion of an embodiment of the floor maintenance device according to the invention.

FIG. 4A is a cross-sectional view of the cloth according to the invention.

FIG. 4B is a top view of the cloth shown in FIG. 4A.

FIG. 5A is a partly cross-sectional view of a portion of another embodiment of the floor maintenance device according to the invention and the cloth attached it.

FIG. 5B corresponds with FIG. 5A and shows the floor maintenance device with the cloth fastening portion in the open position.

FIG. 6A is a cross-sectional view of the structure of the wringing portion of the floor maintenance device according to the invention and its fastening sleeve according to one embodiment.

FIG. 6B is a cross-sectional view of the wringing portion in FIG. 6A and its fastening sleeve as coupled with the wringing portion.

DESCRIPTION OF THE FIGURES

FIG. 3 shows a joint 20 between the shaft 11 and the base portion 40, the joint having a joint axle 21. The squeegee portion 30 made from rubber or similar material is attached to the base portion 40 by means of an adaptor sleeve 31, whose structure and purpose is described below. Cloth fastening portions 50 are located on both sides of the base portion 40 of the floor maintenance device 10, the fastening portions being formed by a groove 51 and by a slit 62 in conjunction with the groove. When a cloth is fastened to the cloth fastening portion 50, the thick edge 61 of the cloth 60 is placed in the groove 51 and the thin portion 62 of the cloth 60 protrudes from the slit 52.

Figure 1:
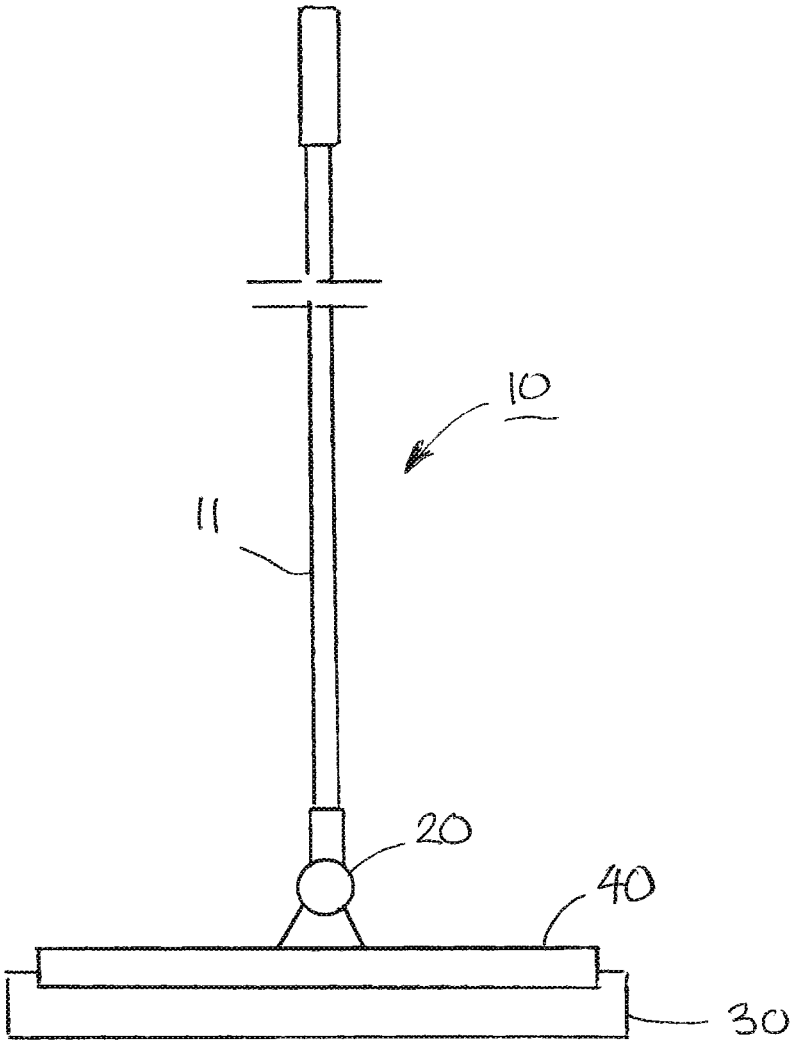
FIG. 1 shows a floor maintenance device 10 according to the prior art, being in this example a squeegee without a cloth fastening portion. The floor maintenance device 10 has a shaft 11 and swivel joint 20, by means of which the shaft 11 is joined with the base portion 40 of the squeegee portion 30.
Figure 2:
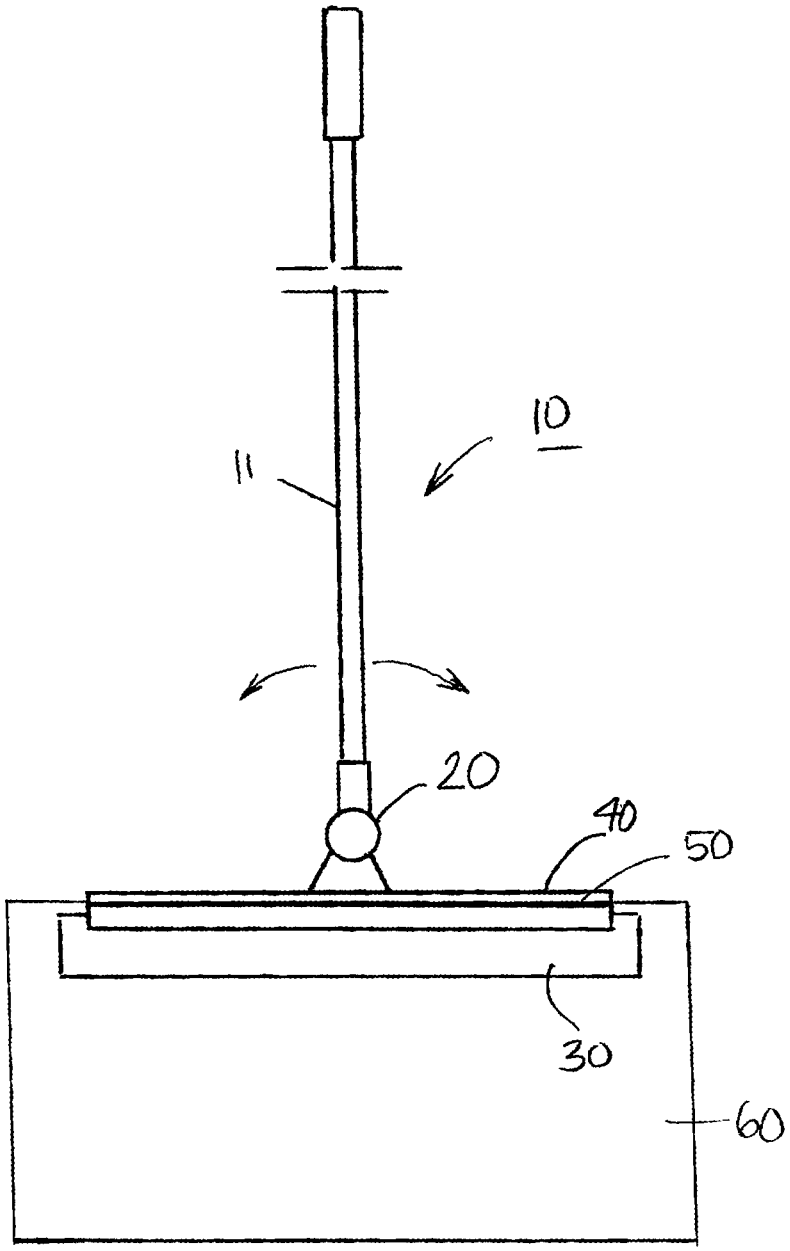
FIG. 2 shows a floor maintenance device 10 according to the invention, wherein a cloth 60 is fastened to the floor maintenance device 10 with a fastening portion 50 according to the invention, the structure of which fastening portion is described in more detail in subsequent figures. Most advantageously, the rubber in the squeegee portion 30 is always wider than the base portion 40 of the floor maintenance device 10, and the cloth 60 is wider than the rubber in the squeegee portion 30.
Figure 3:
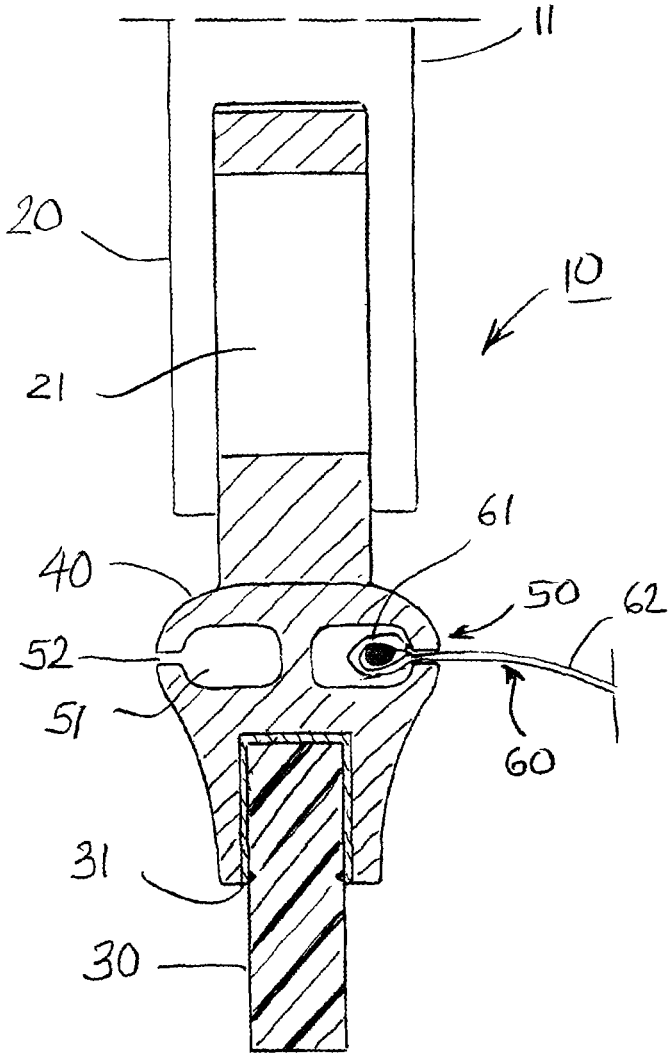
FIG. 3 shows a partially cross-sectional view of an embodiment of the floor maintenance device 10 according to the invention.

In the embodiment shown in FIG. 3, the cloth fastening portions 50 formed in the base portion 40 of the floor maintenance device 10 do not include any moving parts, and thus the thick edge 61 of the cloth 60 must be guided in to the slit 51 at its end. The groove 51 can be open at both ends or only at one end. To make it easier to guide in the thick edge 61, an end of the groove 51 can be shaped in a trumpet-like manner, i.e. expanding curvilinearly. When the thick edge 61 of the cloth 60 is in its place in the groove 51, it cannot slip through the slit 52, and the cloth 60 will stay securely in place during floor maintenance. When the cloth 60 must be changed, the cloth 60 is pulled in the lateral direction whereby the thick edge 61 comes out of the groove 51.

Figure 4A:
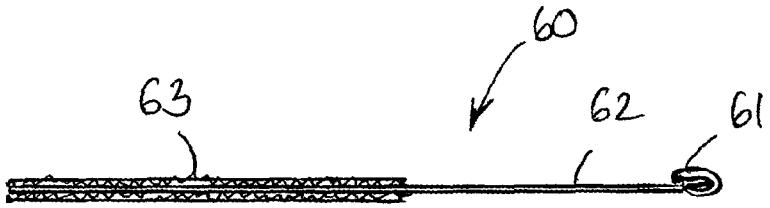

FIG. 4A shows a cross section of the cloth 60 according to the invention. As FIG. 4A shows, the cloth 60 according to this embodiment consists of three portions. The cloth 60 has a thick edge 61 formed for example by folding and sewing the edge of the cloth 60 to a double or multiple fold. A separate thick edge 61 can also be incorporated in the edge of the cloth 60, or an additional thread, cord, band or similar is placed inside the cloth layers. This way the thick edge 61 becomes sufficiently thick so that it will not come out of the groove 51 via the slit 52 by a direct pull.

Figure 4B:
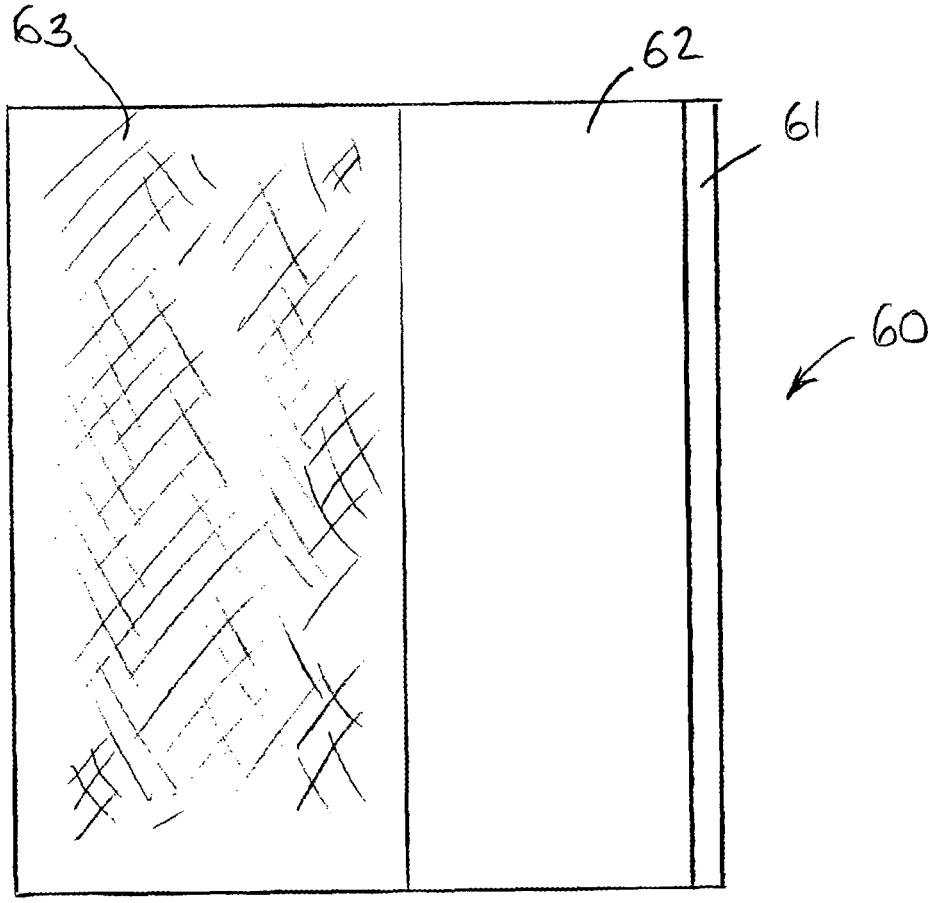

FIG. 4A additionally shows that, adjacent to the thick edge 61, the cloth 60 is smooth and has a relatively thin area 62. The thick edge 61 of the cloth 60 is easy to guide in to the groove 51 as the thin portion 62 of the cloth 60 easily goes into the slit 52 in the fastening portion 50. The third portion of the cloth 60 is the actual floor maintenance area 63, which can be thicker and can have a surface texture suitable for its purpose. FIG. 4B shows a top view of the cloth 60 in FIG. 4A.

Figure 5A:
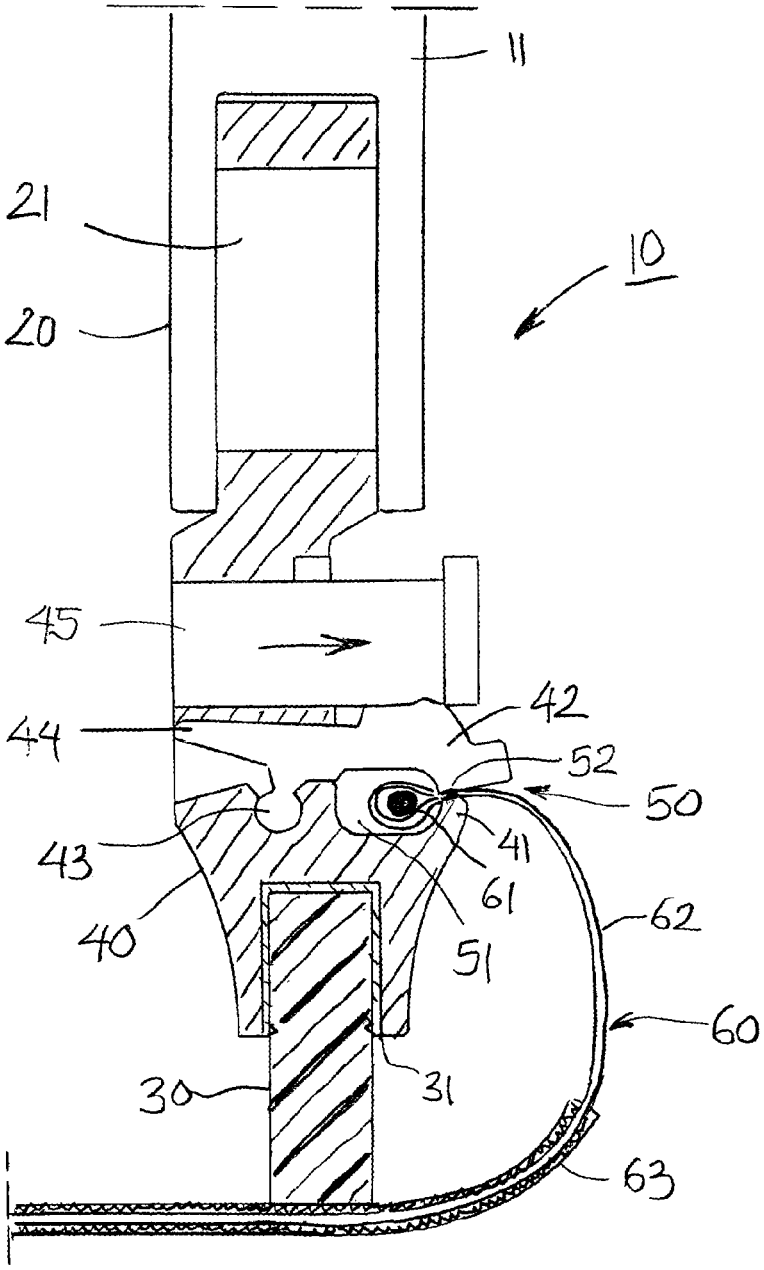

FIG. 5A shows a partially cross-sectional view of a portion of another embodiment of the floor maintenance device 10 according to the invention and the cloth 60 attached to it. As FIG. 5A shows, the cloth 60 is attached to the floor maintenance device 10 so that the thick edge 61 in the cloth 60 is placed in the groove 51 of the cloth fastening portion 50. The thin portion 62 in the cloth 60 comes out of the slit 51 in the groove 51 and the actual floor maintenance area 63 in the cloth 60 is folded under the squeegee portion 30, making it possible to wipe or wash the floor.

The floor maintenance device 10 in FIG. 5A differs from the similar floor maintenance device 10 in FIG. 3 in that the groove 51 in the fastening portion 50 for the cloth 60 in FIG. 5A is formed by the base portion 40 having a fixed portion 41 and a mobile portion 42 joined with the base portion 40 by means of a joint 43. A mobile securing portion 45 incorporated in the structure has been transferred to the right in FIG. 5A, whereby the securing portion 45 secures the mobile portion 42 in the base portion 40 in its place and the floor maintenance device 10 is ready for use.

Figure 5B:
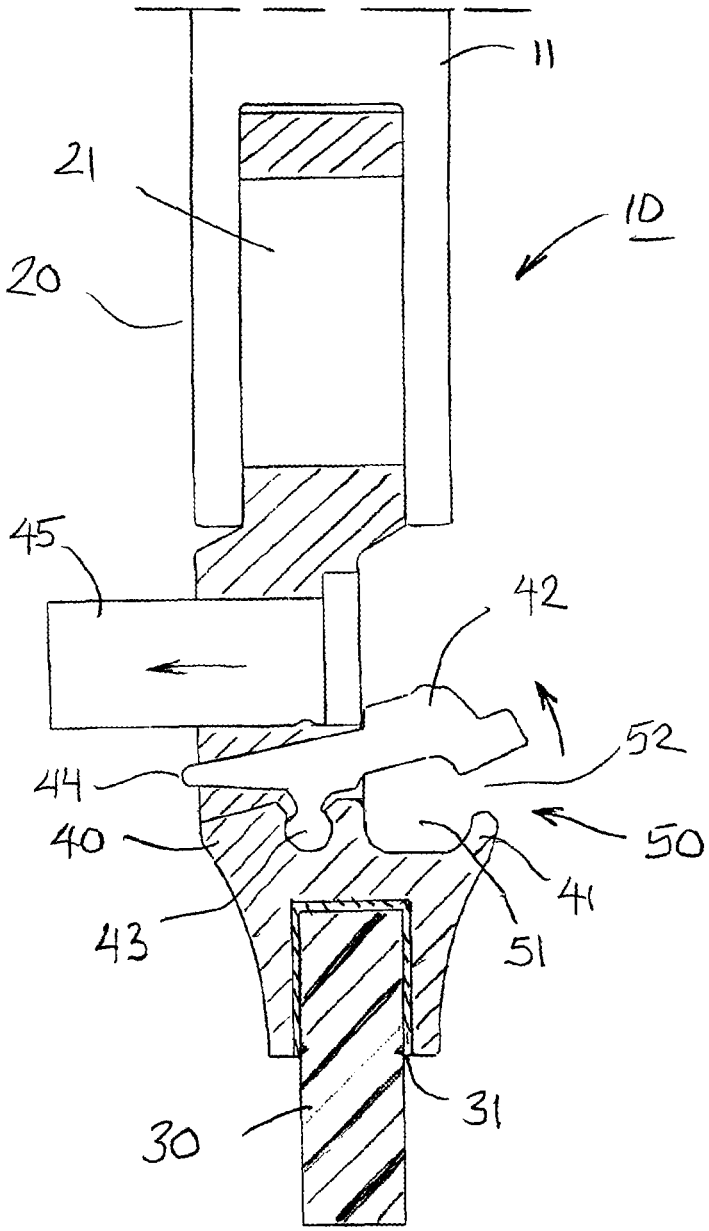

FIG. 5B shows a floor maintenance device 10 corresponding to FIG. 5A in which floor maintenance device the fastening portion 50 for the cloth 60 is opened and the cloth has been removed. To open the cloth fastening portion 50, the mobile securing portion 45 has first been shifted to the left in FIG. 5B, after which the user has pressed down on a protrusion 44 in the mobile portion 42. Thereby the slit 52 in the groove 51 becomes larger, making possible to remove the thick edge 61 in the edge of the cloth 60 from the groove 51. It is very convenient that a used, soiled cloth 60 can be removed from the floor maintenance device 10 merely by allowing the cloth 60 to fall out, without having to touch it.

Figure 6A:
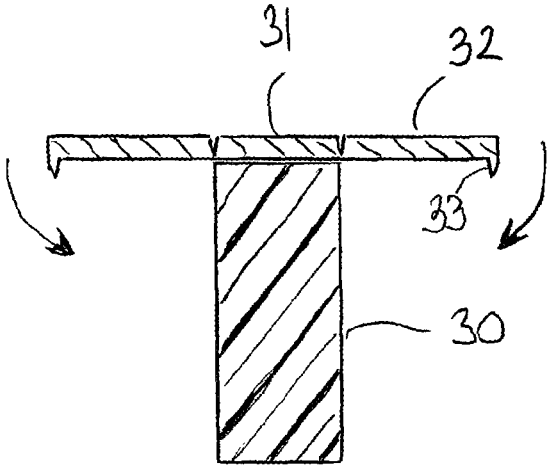
Figure 6B:
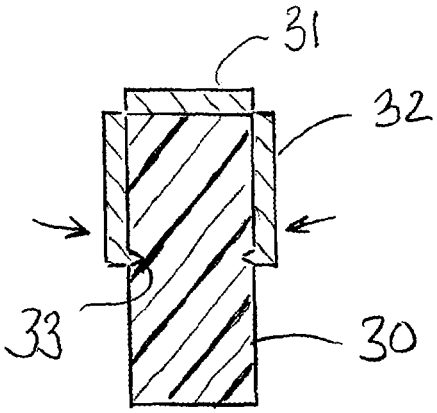

FIG. 6A shows a cross-sectional view of the structure of the squeegee portion 30 and its fastening sleeve 31 in an exemplary embodiment of the floor maintenance device 10 according to the invention. As shown in previous figures, the squeegee portion 30 has been coupled with the base portion 40 in the floor maintenance device 10 by means of an adaptor sleeve 31. The adaptor sleeve 31 is shaped as shown in FIG. 6A, whereby its side portions 32 can be folded against the squeegee portion 30 and the sharp edges 33 are pressed into the rubber in the squeegee portion 30, securing it in place. FIG. 6B shows the adaptor sleeve 31 in its place. Most advantageously, the rubber in the squeegee portion 30 is always wider than the adaptor sleeve 31 or the base portion 40 of the floor maintenance device 10, whereby the soft rubber always touches the wall or furniture first, without scratching them.

The combination of an adaptor sleeve and squeegee portion 30 in FIG. 6B forms a practical unity, making it easy to replace such a module in the base portion 40 of the floor maintenance device 10, instead of the squeegee portion 30 only. The adaptor sleeves 31 and/or rubbers and/or cloths 60 in the squeegee portion 30 can also be made in different colours, whereby a squeegee portion 30 or cloth 60 suitable for the work can always be chosen according to the colour.

ADDITIONAL NOTES

It is obvious to a person skilled in the art that the different embodiments of the invention may vary within the scope of the claims presented below.

LIST OF REFERENCE NUMBERS

10 Floor maintenance device
11 Shaft
20 Joint
30 Squeegee portion
31 Adaptor sleeve
32 Side portion
33 Edge
40 Base portion
41 Fixed portion
42 Mobile portion
43 Joint
44 Protrusion
45 Securing portion
50 Cloth fastening portion
51 Groove
52 Slit
60 Cloth
61 Thick edge
62 Thin area
63 Floor maintenance area

The invention claimed is:

1. A floor maintenance device (10) comprising;

a base portion (40), a squeegee portion (30) composed of rubber or other elastic material and coupled with the base portion (40), a cloth (60) fastening portion (50) formed in the base portion (40) for attaching a cloth (60) having a thick portion formed at an edge thereof to the floor maintenance device (10), and a shaft (11) coupled with the base portion (40) that is either rigid or swivels, by means of a joint (20), said floor maintenance device (10) being characterized in that the cloth (60) fastening portion (50) for attaching a cloth (60) is formed by a groove (51) having a tunnel-like space and a slit (52), whereby the cloth (60) is attachable to the floor maintenance device (10) by placing the thick edge (61) of the cloth in the groove;

wherein said groove (51) having a tunnel-like space and a slit (52) comprises a fixed portion (41) of the base portion (40) and a movable portion (42) provided with a protrusion (44) and joined with the base portion by means of a joint (43), which cooperate to form said groove (51), and a securing portion (45) for securing the mobile portion in the base portion in its place, whereby the cloth (60) fastening portion (50) is openable by shifting the securing portion (45) and pressing the protrusion (44) in the mobile portion (42) so that the tunnel-like groove (51) open and slit (52) becomes larger, after which the thick edge (61) of the cloth can be removed from the groove via the slit.

2. The floor maintenance device (10) according to claim 1, wherein the tunnel-like space formed by the groove (51) is open at one or both of said first and second ends.

3. The floor maintenance device (10) according to claim 2, wherein an expanding portion is formed at one or both of said first and second open ends of the groove (51), whereby it is easier to guide a thick edge (61) of the cloth (60) into one of said first and second open ends.

* * * * *